US005289638A

United States Patent [19]

Chase

[11] Patent Number: 5,289,638

[45] Date of Patent: Mar. 1, 1994

[54] SAFETY CAN OPENER

[76] Inventor: Jack Chase, 1860 NW. 107th Ter., Coral Springs, Fla. 33071

[21] Appl. No.: 20,834

[22] Filed: Feb. 19, 1993

[51] Int. Cl.[5] ..... B67B 7/46

[52] U.S. Cl. ..... 30/417; 30/418; 30/420

[58] Field of Search ..... 30/416, 417, 418, 419, 30/422, 420

[56] References Cited

U.S. PATENT DOCUMENTS

| | | | |
|---|---|---|---|
| 593,377 | 11/1897 | Johnson . | |
| 3,510,941 | 5/1970 | Fyfe | 30/417 |
| 3,719,991 | 3/1973 | French | 30/417 |
| 4,053,981 | 10/1977 | Aberer | 30/41.9 |
| 4,782,594 | 11/1988 | Porucznile et al. | 30/418 |
| 5,121,546 | 6/1992 | Chong | 30/417 |
| 5,170,565 | 12/1992 | Brisard | 30/421 |

*Primary Examiner*—Richard K. Seidel
*Assistant Examiner*—Paul M. Heyrana, Sr.
*Attorney, Agent, or Firm*—Alvin S. Blum

[57] ABSTRACT

A can opener for opening cans of the type having a lid joined to the main body by a rim formed of inner and outer lid surfaces folded onto the upper edge of a can wall. A toothed drive wheel rotatably mounted on a housing engages the inner surface of the rim and forces the outer rim surface against a cutter wheel when a drive shaft is rotated by a turning handle. The turning handle is threaded onto the drive shaft so that rotating the handle both rotates the drive wheel and pulls it tightly against the housing which holds a rotatably mounted cutting wheel. This cuts through the outer lid surface to free the lid from the can. The cutting wheel has an outwardly flaring upper cutting edge and the drive wheel has a curved surface for contacting the inner margin of the rim. The two surfaces coact to force the upper cut surface outwardly and the lower cut surface inwardly. Consequently, as the lid is cut free, it is flared outwardly from the can wall for ease of manual removal and replacement. The cut surfaces are not sharp and there is no contact between the opener and the can contents. Any metal shavings would fall outside the can because the cut is outside the wall of the can.

9 Claims, 1 Drawing Sheet

SAFETY CAN OPENER

This invention relates to can openers and more particularly to openers which avoid some of the hazards of conventional can openers.

Background of the Invention

Conventional can openers cut through the metal of the end closure by making a circular cut about the perimeter of the can end just inward of the can rim. In the process, small bits of metal may break loose from the cut edge and drop into the can contents. The cutting tool itself may come into contact with the can contents, transferring contaminants from one container to another. The soiled cutter may breed organisms for later transfer into another can. The cut edge of the can end is sharp. It may cut the user, especially when removing it and when accessing the contents through the cut rim remaining on the can.

Various devices have been invented to overcome these problems of conventional can openers. U.S. Pat. No. 3,045,617 issued Jul. 24, 1962 to Dieter et al. is exemplary of openers which unfold the seam where the top joins the wall. This requires complex structure and considerable energy to unfold this tightly sealed joint.

Because metal cans are made of very thin metal sheets, it is easier to cut through the metal than to unfold the seam. By cutting through the can lid at its perimeter on the outside of the seam, one avoids many of the hazards of convention cutting can openers. Any metal bits will fall outside the container and there is no chance of the cutter contacting the can contents. U.S. Pat. No. 4,734,986 issued Apr. 5, 1988 to Peters is exemplary of can openers which cut the can top at the outside of the seam. It teaches a cutting wheel with a double bevel held between two flanges which touch the rim and control depth of penetration of the cutter wheel which rotates on an axis. On a parallel axle a drive wheel engages the inner portion of the rim. This axle is mounted on an eccentric disc so that the cutter and drive wheels may be brought together with the rim therebetween. This cutter arrangement forces the cut edge of the top against the rim and consequently the cut top is not readily lifted from the can. Peters teaches an accessory element for prying the cut top from the can. The top is such a tight fit that it is not readily replaced on the open can.

SUMMARY OF THE INVENTION

It is accordingly an object of the invention to provide a can opener which cuts through the top end of a can outside of the rim while also spreading the cut edge outward from the rim so that it is readily removed and replaced manually. It is another object that the opener operate with very little effort for use by weak persons. It is yet another object that the opener be economical of manufacture.

The can opener of the invention comprises a housing supporting a cutter wheel mounted on an axle which is vertical when in operating position on a can engaging the outer edge of the can rim. A toothed drive wheel is mounted on an axle which is transverse to the cutter wheel axle. It is turnable by a turning handle. The drive wheel is arranged to engage the inside surface of the can rim while the cutter wheel engages the outer surface of the rim. The drive wheel is so mounted that as the turning handle is rotated in a can opening direction, the drive wheel rotates and also is drawn toward the cutter wheel to thereby force the cutter wheel through the outer layer of the rim.

The cutter wheel is in the shape of a frustum of a cone with the greater diameter at its top. The drive wheel is also provided with a tapered edge with the diameter greatest away from the cutter. When this drive wheel is forced against the inside of the rim, it bends the rim outward at its top while the tapered cutter wheel forces the lower outside portion of the rim inward while cutting. This action forces the cut off rim outwardly from the can wall as it is being cut. When the cut is complete, the cut off top is simply lifted off the container because its edge has been spread outward from the side of the can for easy grasping by the hand. Furthermore, the teeth of the drive wheel force the rim into an undulating motion. This action provides easier cutting because only very small portions of metal are exposed to the cutter wheel at any one time.

These and other objects, advantages and features of the invention will become more apparent when the detailed description is considered in conjunction with the drawings, in which:

DETAILED DESCRIPTION OF PREFERRED EMBODIMENT

Figure 1:
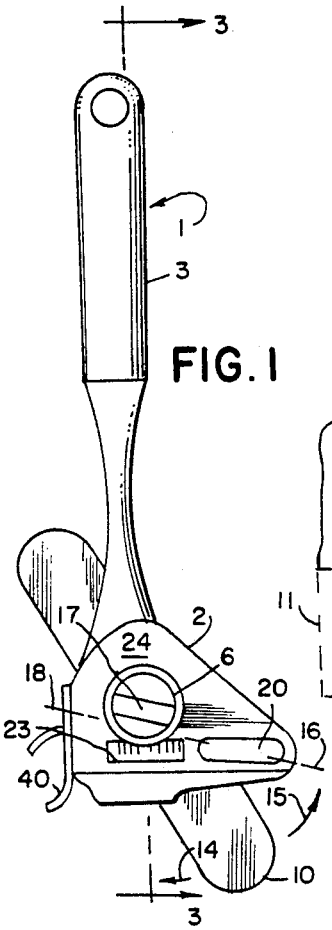
FIG. 1 is a front elevation view of the can opener.

Referring now first to FIGS. 1–4, the can opener 1 of the invention comprises a plastic housing 2 and elongate grip member 3. The housing supports a rotary shaft 4 journalled in a hole 5 in the housing. At one end of shaft 4 is affixed a drive wheel 6 with a curved and toothed or serrated inner surface 7, which slopes to a surface 33 parallel to the shaft 4. A spring 8 urges the drive wheel away from the housing. The other end of the shaft 4 is provided with screw threads 9. A turning handle 10 is provided with matching screw threads 12. The handle 10 is prevented from screwing completely off the shaft by locking pin 13 securely fixed to the shaft 4. Rigid or resilient washers 34 may be provided. When handle 10 is rotated in a first direction 14 prior to cutting, the handle unscrews partially from the shaft and compression spring 8 forces the drive wheel 6 away from the housing 2, providing access space for fitting the top edge 16 of the can into the space 25 between drive wheel and housing in preparation for opening the can. A projection 17 on the drive wheel may be held during this rotation to prevent the shaft from rotating with the handle.

A ridge 19 below the drive shaft engages the side of the can and provides correct horizontal orientation of the shaft. Rotatably mounted on an axle 21 is cutter wheel 22. The axle 21 is mounted at right angles to drive shaft 4 in a recess 32 in housing 2. The cutter wheel 22 has an outwardly flaring, sharp, upper edge 23 with a series of uniformly spaced vertical slits 35 therein. The upper cutting edge 23 is mounted so that it extends into the space 25 between the inner curved surface 7 of the drive wheel and the plane of the adjacent contact face 24 of the housing.

An angled guide bar 20 projects from the face 24 of the housing. When opener 1 is correctly mounted on a can, with grip 3 vertical, the guide bar 20 engages the upper edge 16 of can 18 and fixes the vertical position of drive and cutting wheels relative to the can.

To operate the can opener, the handle 10 is first rotated in first direction 14 while drive wheel 6 is held from turning by holding projection 17. This partially unscrews the handle 10 from the shaft 4 and compression spring 8 forces the drive wheel away from the face 24 of the housing. This provides an expanded space 25 for insertion of the top edge 16 of the can. Holding grip 3 upright, the opener 1 is forced down on the can so that drive wheel 6 engages the top 16 of the can, and the guide bar 20 also rests on the top of the can. Handle 20 is then rotated in the second or cutting direction 15. This causes the handle to screw onto the shaft, pulling the drive wheel toward the housing and rotating the drive wheel. The curved, toothed face 7 of the drive wheel is forced against inner surface 27 of the top rim, bending it outwardly and forcing the outer surface 26 of the rim against the sharp, flaring upper edge 23 of the cutter wheel 22. The teeth or serrations in the drive wheel grip the inner edge 27 of the rim so tightly that they emboss serrations in the rim, bend it outward and drive the can around. As the outer surface 26 of the rim is forced against the cutter wheel the rim is cut through the outer layer of metal that was formed from the lid. When the opener has completely circled the can, the lid 27 is completely cut from the can.

Figure 6:
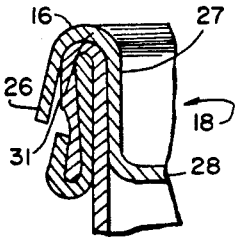
FIG. 6 is a detail sectional view of the can after opening with the can opener of the invention.
Figure 5:
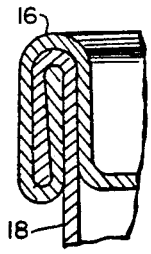
PRIOR ART FIG. 5
FIG. 5 is a detail sectional view of the uncut can.

As shown in FIGS. 5 and 6, the effect of the inner surface 27 being forced outward by the curved drive wheel surface 7 while the cutter wheel presses in the portion 29 of the rim below the cut is to bend the rim outwardly as it is cut free so that it is freed from and flares outwardly from the remainder of the can. It may be readily grasped and lifted up without tools. The cut edges are not sharp to the touch because of the direction of the cutting. The lid may be simply replaced on the can if it is to be reused.

Figure 7:
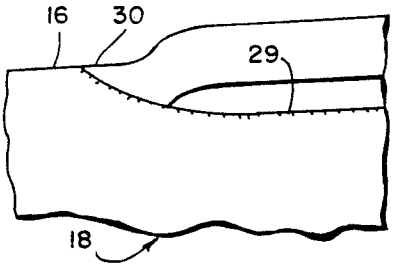
FIG. 7 is a front elevation view of a can partially cut by the can opener of the invention.
Figure 4:
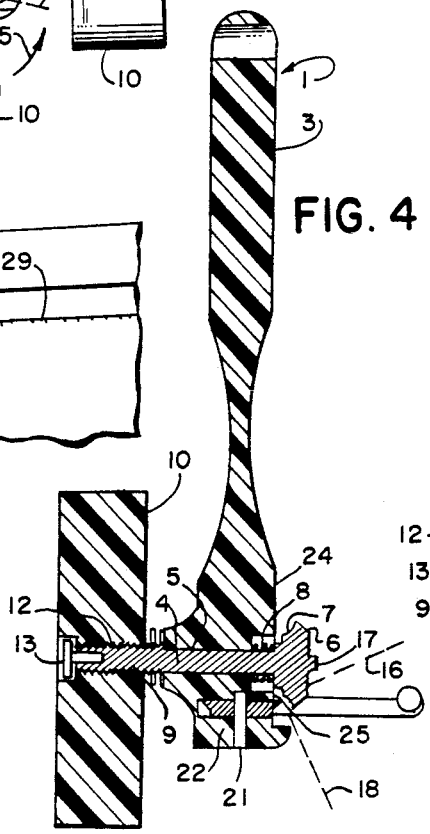
FIG. 4 is a partial sectional view as in FIG. 3 in the can loading condition, greatly enlarged.
Figure 3:
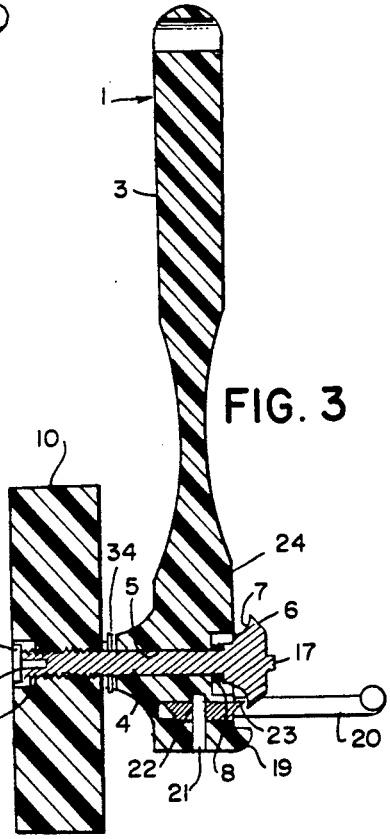
FIG. 3 is a partial sectional view taken through line 3—3 of FIG. 1 in the cutting condition, greatly enlarged.

FIG. 7 shows the effect of the various positioning mechanisms in making the cut. The upper edge 16 of can 18 is shown with the starting of the cut indicated at 30. The cutting wheel is forced down from the edge 16 by its angular orientation until the upper edge 16 engages the horizontal portion 33 of the drive wheel as the can rotates. The cutting process actually separates the cut lid 28 from the lower cut edge 29 and forces it upward as the cut is being made. The exposed top of the opened can is actually the finished top 31 of the body of the can, so that it does not present a sharp cut edge to the user.

Figure 2:
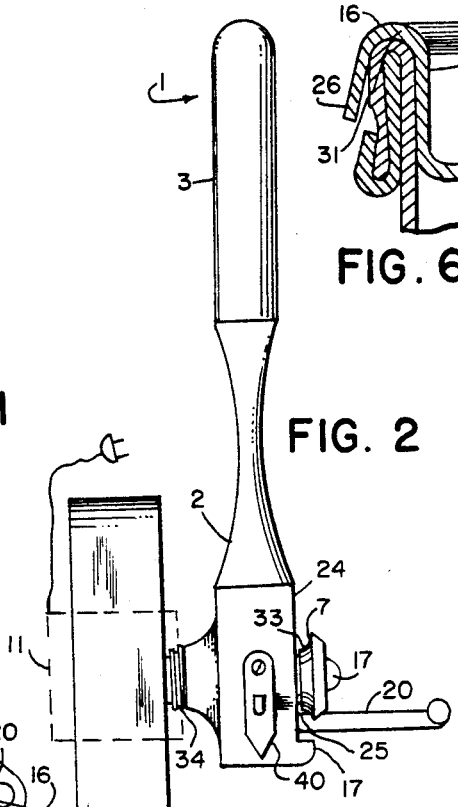
FIG. 2 is a side elevation view of the can opener.

As shown in FIGS. 1 and 2, the can opener may optionally be provided with a can punching and bottle cap prying accessory 40 of the type well known in the art which does not require further description and electric motor drive 11 shown in phantom.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A can opener for opening a can having an end lid joined to the wall of a main body by a rim that includes inner and outer lid surfaces folded over the upper edge of the wall, whereby the lid is separated from the wall by cutting through the outer lid surface while simultaneously bending the outer lid surface above the cut outwardly while the wall is held vertically, the opener comprising:

a) a housing having a contact face;

b) an elongate gripping member having a long axis extending upward from the housing;

c) a drive shaft having a long axis and provided at a first end with screw threads;

d) a drive wheel connected to a second end of said drive shaft, said drive wheel having an outer face located away from said drive shaft and a curved and toothed or serrated inner face located toward the drive shaft, the inner face curving from an obtuse angle to the axis of the drive shaft at the perimeter to substantially parallel to the drive shaft at the innermost portion adjacent the drive shaft;

e) means rotatably mounting the drive shaft in the housing with the drive wheel extending from the contact face and the threaded first end extending from an opposed face of the housing;

f) turning means threadably mounted on the first end, whereby, when the turning means is rotated in a first direction, the drive wheel is rotated and pulled toward the contact face, and, when the turning means is rotated in a second direction, the drive wheel is moved away from the contact face to permit entry of a can rim therebetween;

g) securing means connected to the shaft for preventing complete unscrewing of the turning means from the drive shaft;

h) a cutter wheel axle mounted in a recess in the housing with the axis thereof oriented transverse to the axis of the drive shaft;

i) a cutter wheel rotatably mounted on the axle, the cutter wheel having a greater upper diameter and a lesser lower diameter, to thereby present a sharp, outwardly-flaring, upper cutter edge which extends out from the recess beyond the contact face, located at a position opposite and between the outermost and innermost portions of the inner face of the drive wheel;

j) the contact face and the inner face of the drive wheel defining a space below the drive shaft for receiving the upper rim of a can with the drive wheel engaging the inner surface of the rim and, as the drive wheel is rotated in the first direction, the drive wheel bends the inner surface outwards, forces the outer surface against the cutting wheel, and rotates the can past the cutting wheel, thereby cutting through the lid and simultaneously bending the cut lid outwardly for ease of removal and replacement.

2. The can opener according to claim 1 further comprising:

a) a rigid guide bar extending from said contact face at a location below the drive shaft and beside the recess.

b) an elongate ridge projecting from said contact face below the cutting wheel and the guide bar.

3. The can opener according to claim 2, in which said turning means includes a manually operated handle.

4. The can opener according to claim 2, in which said turning means includes an electric motor.

5. The can opener according to claim 2 further comprising resilient bias means connected between the housing and the drive wheel urging the drive wheel away from the housing.

6. The can opener according to claim 2 including a holding means on the outer face of the drive wheel for manually preventing rotation thereof while rotating the drive shaft in the second direction to move the drive wheel away from the contact face for inserting a can rim therebetween.

7. The can opener according to claim 2, in which the upper edge of the cutting wheel is provided with a plurality of vertical slits.

8. The can opener according to claim 2 further comprising a can punching and bottle cap prying accessory mounted on the housing.

9. A can opener for opening a can having an end lid joined to the wall of a main body by a rim that includes inner and outer lid surfaces folded over the upper edge of the wall, whereby the lid is separated from the wall by cutting through the outer lid surface while simultaneously bending the outer lid surface above the cut outwardly while the wall is held vertically, the opener comprising:

a) a housing having a contact face;

b) an elongate gripping member having a long axis extending upward from the housing;

c) a drive shaft having a long axis and provided at a first end with screw threads;

d) a drive wheel connected to a second end of said drive shaft, said drive wheel having an outer face located away from said drive shaft and an arcuate and toothed or serrated inner face located toward the drive shaft, the inner face curving from an obtuse angle to the axis of the drive shaft at the perimeter to substantially parallel to the drive shaft at the innermost portion adjacent the drive shaft;

e) means rotatably mounting the drive shaft in the housing with the drive wheel extending from the contact face and the threaded first end extending from an opposed face of the housing;

f) turning means threadably mounted on the first end, whereby, when the turning means is rotated in a first direction, the drive wheel is rotated and pulled toward the contact face, and, when the turning means is rotated in a second direction, the drive wheel is moved away from the contact face to permit entry of a can rim therebetween;

g) securing means connected to the shaft for preventing complete unscrewing of the turning means from the drive shaft;

h) a cutter wheel axle mounted in a recess in the housing with the axis thereof oriented transverse to the axis of the drive shaft, and extending in substantially the same direction as said long axis of said gripping member;

i) a cutter wheel rotatably mounted on the axle, the cutter wheel having a greater upper diameter and a lesser lower diameter, to thereby present a sharp, outwardly-flaring, upper cutter edge which extends out from the recess beyond the contact face, located at a position opposite and between the outermost and innermost portions of the inner face of the drive wheel;

j) the contact face and the inner face of the drive wheel defining a space below the drive shaft for receiving the upper rim of a can with the drive wheel engaging the inner surface of the rim and, as the drive wheel is rotated in the first direction, the drive wheel bends the inner surface outwards, forces the outer surface against the cutting wheel, and rotates the can past the cutting wheel, thereby cutting through the lid and simultaneously bending the cut lid outwardly for ease of removal and replacement.

* * * * *